US009765475B2

(12) United States Patent
Lee et al.

(10) Patent No.: US 9,765,475 B2
(45) Date of Patent: Sep. 19, 2017

(54) STEAMING DEVICE

(71) Applicant: KONINKLIJKE PHILIPS N.V., Eindhoven (NL)

(72) Inventors: Kean Hao Raymond Lee, Eindhoven (NL); Boon Khian Ching, Eindhoven (NL); Hee Keng Chua, Eindhoven (NL); Yong Jiang, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/898,499

(22) PCT Filed: Jun. 27, 2014

(86) PCT No.: PCT/IB2014/062647
§ 371 (c)(1),
(2) Date: Dec. 15, 2015

(87) PCT Pub. No.: WO2014/207707
PCT Pub. Date: Dec. 31, 2014

(65) Prior Publication Data

US 2016/0122937 A1 May 5, 2016

Related U.S. Application Data

(60) Provisional application No. 61/840,880, filed on Jun. 28, 2013.

(51) Int. Cl.

| | |
|---|---|
| ***D06F 75/16*** | (2006.01) |
| ***D06F 75/14*** | (2006.01) |
| ***D06F 75/40*** | (2006.01) |
| ***D06F 87/00*** | (2006.01) |
| ***D06F 79/02*** | (2006.01) |
| ***F01K 5/02*** | (2006.01) |

(52) U.S. Cl.
CPC ..... *D06F 75/16* (2013.01); *D06F 75/14* (2013.01); *D06F 75/40* (2013.01); *D06F 79/02* (2013.01);
(Continued)

(58) Field of Classification Search
CPC ..... D06F 75/16; D06F 75/40; D06F 75/06; D06F 75/10; D06F 75/14; D06F 75/18;
(Continued)

(56) References Cited

U.S. PATENT DOCUMENTS 2,188,011 A * 1/1940 Miller ..... D06F 75/16 38/77.81
2,762,143 A * 9/1956 Hoecker ..... D06F 75/16 38/77.5
(Continued)

FOREIGN PATENT DOCUMENTS

GB 2345921 A 7/2000
JP 57111137 A 7/1982
(Continued)

*Primary Examiner* — Ismael Izaguirre

(57) ABSTRACT

A steaming device (1) is operable in a cordless mode and has a steaming body (2) having a first water chamber (6), a second water chamber (7), a steam generator (8), a first fluid path (20) between the first water chamber (6) and the second water chamber (7), and a second fluid path (26) between the second water chamber (7) and the steam generator (8). The first fluid path (20) is configured to prevent water flow from the first water chamber (6) to the second water chamber (7) when the steaming body (2) is orientated in a normal operating position. The first fluid path (20) is also configured to allow water flow from the first water chamber (6) to the second water chamber (7) when the steaming body is orientated in a rest position in which the steaming body is inclined at an angle to the normal operating position.

20 Claims, 4 Drawing Sheets

(52) U.S. Cl.
CPC ..... *D06F 79/023* (2013.01); *D06F 87/00* (2013.01); *F01K 5/02* (2013.01)

(58) Field of Classification Search
CPC ..... D06F 75/20; D06F 87/00; D06F 79/02; D06F 79/023; D06F 79/026; F01K 5/02
See application file for complete search history.

(56) References Cited

U.S. PATENT DOCUMENTS

| | | | | | |
|---|---|---|---|---|---|
| 2,832,160 | A * | 4/1958 | Beach | D06F 75/14 | 38/77.82 |
| 5,063,697 | A * | 11/1991 | Valente | D06F 75/14 | 210/282 |
| 5,138,778 | A * | 8/1992 | Brandolini | D06F 75/14 | 210/282 |
| 5,926,983 | A * | 7/1999 | Tee | D06F 75/14 | 38/77.82 |
| 6,622,404 | B2 * | 9/2003 | Valiyambath | D06F 75/02 | 38/77.8 |

FOREIGN PATENT DOCUMENTS

| | | | |
|---|---|---|---|
| JP | 62140224 | A | 6/1987 |
| JP | 4073100 | A | 3/1992 |
| JP | 4122395 | A | 4/1992 |
| JP | 06205898 | A | 7/1994 |
| JP | 8141294 | A | 6/1996 |
| JP | 2001204997 | A | 7/2001 |
| JP | 2007089640 | A | 4/2007 |
| WO | 9826124 | A1 | 6/1998 |
| WO | 2005014915 | A1 | 2/2005 |

* cited by examiner

STEAMING DEVICE

This application is the U.S. National Phase application under 35 U.S.C. §371 of International Application No. PCT/IB2014/062647, filed on Jun. 27, 2014, which claims the benefit of U.S. Provisional Application No. 61/840,880 filed on Jun. 28, 2013. These applications are hereby incorporated by reference herein.

FIELD OF THE INVENTION

The present invention relates to a steaming device which is operable in a cordless mode. In particular, the present invention relates to a garment steaming device, such as a cordless steam iron or cordless garment steamer for steaming garments, a device for cleaning surfaces such as table tops, or a device for treating textile surfaces and/or mattresses.

BACKGROUND OF THE INVENTION

Steaming devices, such as a steam iron, are generally used to remove creases from fabric, such as clothing and bedding. A steam iron generally includes a main body with a handle which is held by a user, and a sole plate at a lower end of the body with a planar ironing surface which is pressed or located against a fabric. The fabric to be pressed is generally placed on a horizontal surface, such as an ironing board, and the ironing surface of the sole plate pressed against the fabric. The steam iron is in a normal operating position when the planar ironing surface is in a horizontal orientation.

A steam generator is used to convert water fed from a water chamber into steam which is directed through the sole plate towards the fabric to be pressed. The steam generator may include the sole plate which is heated to convert water into steam and to heat the ironing surface. However, the sole plate generally cools down as water flows against it to be converted into steam, and the sole plate is moved over a fabric. This leads to condensation and/or water droplets forming on the fabric, which dampens the fabric. Therefore, it is necessary to allow the steam iron to heat up again in between ironing operations.

Such a problem is particularly acute with cordless steam irons. Cordless steam irons comprise a steaming body and a stand on which the steaming body is removably supported. The steaming body has a sole plate and a steam generator. The stand has a power supply for supplying energy to the steaming body to heat up the sole plate when the steaming body is placed on the stand. When the steaming body is removed from the stand, energy is not supplied to the steaming body and so the temperature of the sole plate will drop as the heat is used to evaporate the water fed to it. The sole plate is only heated up again when the steaming body is returned to the stand. Therefore, water droplets are known to form on the garment as the temperature of the sole plate falls below a reference temperature.

It is known to provide an alarm device that detects the temperature of the heated surface and indicates when the detected temperature drops below a reference temperature to indicate when the steaming body should be returned to the stand.

SUMMARY OF THE INVENTION

It is an object of the invention to provide a steaming device, which is operable in a cordless mode, which substantially alleviates or overcomes the problems mentioned above.

According to embodiments of the present invention, there is provided a steaming device operable in a cordless mode comprising a steaming body having a first water chamber, a second water chamber, a steam generator, a first fluid path between the first water chamber and the second water chamber, and a second fluid path between the second water chamber and the steam generator, wherein the first fluid path is configured to prevent water flow from the first water chamber to the second water chamber when the steaming body is orientated in a normal operating position and configured to allow water flow from the first water chamber to the second water chamber when the steaming body is orientated in a rest position in which the steaming body is inclined at an angle to the normal operating position.

The above arrangement limits the quantity of water that is available to the steam generator when the steaming device acts on a fabric. This aids the prevention of water leakage from the steam generator to the fabric. This also provides a simple arrangement for refilling the second water chamber. This means that second water chamber is reliably refilled when the steaming body is moved into its rest position. It will be understood that water does not flow from the first water chamber to the second water chamber when there is a slight tilt of the steaming body, that is a slight deviation of angle from its normal operating position.

The first fluid path may be configured so that water flows by gravity from the first water chamber to the second water chamber when the steaming body is in the rest position.

Therefore, a mechanism, such as a pump, to supply water from the first water chamber to the second water chamber is not required to urge water to flow between the first and second water chambers. This simplifies the arrangement of the steaming body, aids reliability and reduces cost.

The second fluid path may be configured to prevent water flow to the steam generator when the steaming body is orientated in the rest position.

The second fluid path may be configured to allow water flow to the steam generator when the steaming body is orientated in the normal operating position.

With this arrangement steam generation ends when the steaming body is orientated in the rest position. This aids energy efficiency and minimises water usage when the steaming body is not in the normal operating position.

The above arrangements mean that steam is automatically generated when the steaming body is orientated in its normal operating position, and restricted from producing steam when the steaming body is orientated in its rest position. Therefore, it is not necessary to have a user operated mechanism to control steam generation. Furthermore, the steaming body restricts the flow of water from a water reservoir to the steam generator when the energy capacity of the steam generator is insufficient to evaporate water, and so it is not necessary to provide a drip-stop arrangement.

The steaming device may further comprise a power supply. The flow rate of water through the first fluid path when the steaming body is in the rest position is a function of the rate of energy transfer to the steam generator so that the stored energy capacity of the steam generator is sufficient to evaporate the volume of water in the second water chamber.

This means that the volume of water available to the steam generator does not exceed the available stored energy capacity of the steam generator to evaporate the water. Therefore, during use sufficient heat energy is available to evaporate the total volume of water in the second water chamber and so ironing can be performed without causing condensation, irrespective of the quantity of energy supplied to, and therefore charging time of, the steaming body.

The second water chamber may be configured to hold a maximum volume of water when the steaming body is in the rest position.

The maximum volume of water may be a function of a maximum stored energy capacity of the steam generator which is capable of evaporating the maximum volume of water.

The maximum volume of water may be between 10 g and 20 g.

The maximum volume of water in second water chamber helps to prevent the steam generator from cooling down too much to be unable to evaporate water fed to the steam generator prior to all the water available to the steam generator being used. Therefore, dampening of the fabric of a garment is minimised.

The water level in the second water chamber may be visible. This allows a user to be able to observe when it is necessary to recharge the steaming body. Therefore, the second water chamber is able to act as an indicator to the user. This also allows a user to observe when the steaming body is fully charged for use. This may also allow a user to determine the remaining stored energy of the steam generator. This minimises the cost of manufacture as it is not necessary to provide a separate audio or visual indicator to the user.

The volume of the second water chamber may be smaller than the volume of the first water chamber.

This means that it is possible to perform several ironing operations without it being necessary to refill the steaming body with water.

The second fluid path may have a second fluid path outlet to the steam generator which is disposed above a maximum water level in the second water chamber when the steaming body is orientated in the rest position.

This means that water is prevented from flowing between the second water chamber and the steam generator when the steaming body is in its rest position without the need for a stop valve or non-drip valve. This simplifies the arrangement of the steaming device, improves reliability and minimises costs.

A first fluid path outlet to the second water chamber may be above the maximum water level in the first water chamber when the steaming body is orientated in the normal operating position.

Therefore, water is restricted from flowing through the first fluid path when the steaming body is orientated in the normal operating position. This means that the volume of water available to the steam generator is restricted.

The first fluid path may also comprise a first fluid path inlet from the first water chamber. The first fluid path may define a non-linear path between the first fluid path inlet and the first fluid path outlet. Therefore, the first fluid path outlet may be offset from the first fluid path inlet. The first fluid path may define a curved or angled fluid path.

The first fluid path outlet may be above the first fluid path inlet.

Therefore, water is restricted from accidentally flowing along the first fluid path due to movement of the steaming body during use of the steaming body in the normal operating position causing water motion in the first water chamber.

The first fluid path may comprise a first part and a second part, the first part extending at an angle to the second part.

The first part may extend between the first water chamber and the second water chamber. The second part may extend in the first water chamber. The first part may extend substantially perpendicular to the second part. The second part may extend downwardly in the first water chamber.

The above arrangements help to restrict water from accidentally flowing between the first water chamber and the second water chamber when the steaming body is orientated in its normal operating position, such as during the movement of the steaming body over a garment in normal operation.

The steaming device may further comprise a water reservoir, the first water chamber and second water chamber being defined in the water reservoir by a divider. The first fluid path outlet may be at an upper end of the divider.

Therefore it is possible to provide a single container to act as the first and second water chamber. This simplifies the arrangement of the steaming body and minimises production costs.

The divider may comprise a first wall and a second wall, wherein the first fluid path is defined between the first wall and the second wall.

The first fluid path inlet may be formed at a lower end of the first wall, and the first fluid path outlet may be formed at an upper end of the second wall.

The second water chamber may further comprise an air vent in fluid connection to atmosphere.

This means that air is able to flow into the second water chamber when water flows from the second water chamber to the second fluid path, and air is able to flow out of the second water chamber when water flows into the second water chamber. This minimises restriction to the water flow due to a pressure differential.

The steaming device may further comprise a stand configured to removably support the steaming body in a rest position in which the steaming body is inclined at an angle to a normal operating position.

This means that it is relatively straightforward to orientate the steaming body in the rest position.

The stand may be configured to provide a supply of energy to the steaming body when the steaming body is received on the stand.

The steaming body may be inclined a predetermined angle to a normal operating position when the steaming body is orientated in the rest position. The steaming body may be inclined at an angle of 30 degrees, or at least 30 degrees, to a normal operating position when the steaming body is orientated in the rest position. Therefore, the first fluid path is configured to prevent water flow into the second water chamber when the steaming body is inclined at an angle of less than 30 degrees from the normal operating position. This helps prevent a slight tilt of the steaming body during pressing of a fabric of a garment from causing water to flow into the second water chamber from the first water chamber.

The steaming body may further comprise a sole plate having an ironing surface. The sole plate may form part of the steam generator. The steaming body may be orientated in a normal operating position when the ironing surface is orientated horizontally.

According to another aspect of the invention, the steaming device is a garment steaming device. The garment steaming device may be a cordless steam iron or a cordless garment steamer for steaming garments.

According to another aspect of the invention, the steaming device is a device for cleaning surfaces such as table tops. According to another aspect of the invention, the steaming device is a device for treating textile surfaces and/or mattresses.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
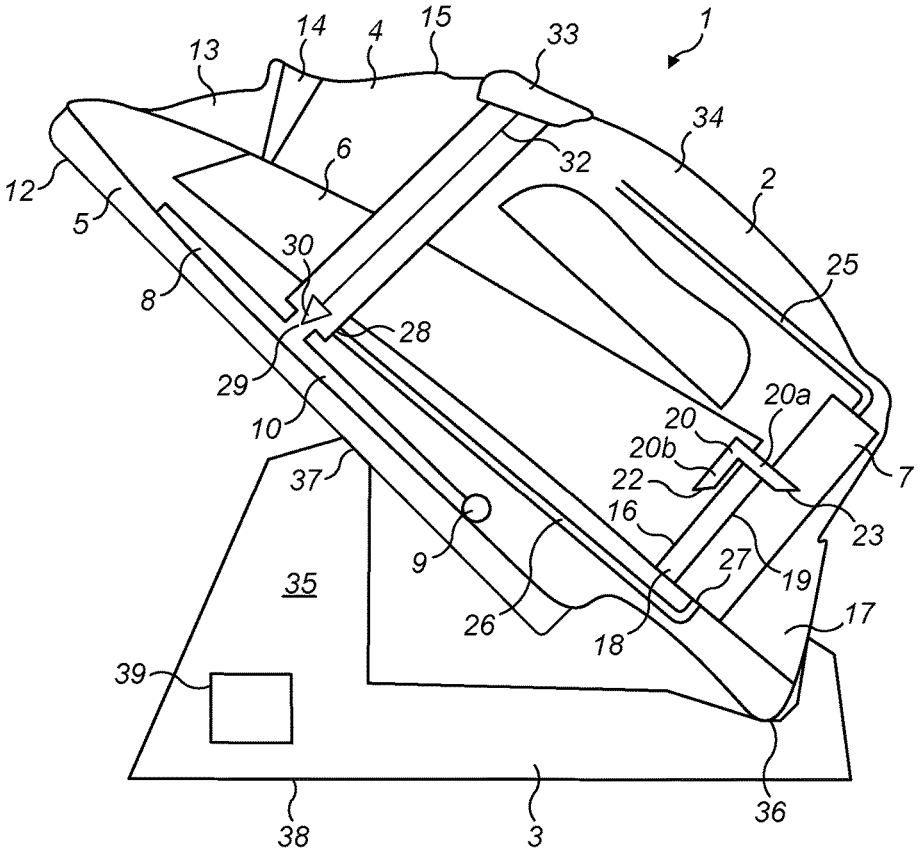
FIG. 1 shows a cross-sectional side view of a cordless steam iron with a steaming body received on a stand with the steaming body in its rest position.

Referring now to FIGS. 1 to 4, a cordless steam iron 1 is shown. The cordless steam iron 1 acts as a garment steaming device.

The cordless steam iron 1 comprises a steaming body 2 and a stand 3. The stand 3 is configured to receive the steaming body 2. The stand 3 supports the steaming body 2.

The steaming body 2 comprises a housing 4 with a sole plate 5 enclosing a lower side of the housing 4. The sole plate 5 is formed from a heat conductive material, such as aluminium. The steaming body 2 further comprises a first water chamber 6, a second water chamber 7 and a steam generator 8. The first water chamber 6 and second water chamber 7 together form a water reservoir.

The steam generator 8 is configured to heat water to convert the water into steam. The steam generator 8 comprises a heater 9 and a steam chamber 10. The heater 9 comprises one or more heating elements. In the present embodiment, the sole plate 5 forms part of the steam generator 8. The steam chamber 10 is defined in the sole plate 5. The heater 9 heats the sole plate 5 and so evaporates water fed into the steam chamber 10. The sole plate 5 has an ironing surface 12. The ironing surface 12 forms an outer face of the steaming body 2. The ironing surface 12 is planar. When the heater 9 is operated, the heater therefore also heats the ironing surface 12. Alternatively, the steam generator 8 is separate from the sole plate 5. In such an embodiment, the sole plate with ironing surface may be heated by an independent heating means.

When a fabric of a garment is ironed, the fabric is typically placed on a horizontal surface and the ironing surface 12 is disposed thereagainst. The ironing surface 12 may comprise a non-stick layer. When the planar ironing surface 12 is orientated to extend along a horizontal plane, the steaming body 2 is orientated in its normal operating condition. That is, the normal condition in which the steaming body 2 is used to press and steam the fabric of a garment.

Steam openings are formed through the sole plate 5 through which steam is able to pass to be imparted onto the fabric of a garment to be ironed. The steam openings are in fluid communication with the steam chamber 10. Therefore, steam produced in the steam chamber 10 is fed through the steam openings to be imparted on the fabric.

The first water chamber 6 acts as a main water chamber. The first water chamber 6 extends towards a front end 13 of the steaming body 2. The first water chamber 6 is configured to receive and hold water. A filling port 14 allows water to be fed into the first water chamber 6. The filling port 14 extends from the upper end of the first water chamber 6, proximate to the front end 13 of the steaming body 2. The filling port 14 extends between the first water chamber 6 and an upper surface 15 of the housing 4. The filling port 14 also acts as an air vent to allow air to flow into the first water chamber 6 to prevent a vacuum from being created in the first water chamber 6 when water flows from the first water chamber 6, as will become apparent hereinafter. A rear face 16 of the first water chamber 6 extends proximate to the heel or rear end 17 of the steaming body 2.

The second water chamber 7 acts as a secondary water chamber. The second water chamber 7 is disposed at the heel or rear end 17 of the steaming body 2. The second water chamber 7 is disposed adjacent to a rear end of the first water chamber 6. The second water chamber 7 is configured to receive and hold water. The volume of the second water chamber 7 is less than the volume of the first water chamber 6. A wall 18 is formed between a front face 19 of the second water chamber 7 and the rear face 16 of the first water chamber 6. The wall 18 may define a gap between the first and second water chambers 6, 7.

A first fluid path 20 communicates between the first and second water chambers 6, 7. The first fluid path 20 is a water passage. The first fluid path 20 extends between the first and second water chambers 6, 7. The first fluid path 20 extends from the upper end of the first water chamber 6. The first fluid path 20 extends through the rear face 16 of the first water chamber 6 to the front face 19 of the second water chamber 7. The first fluid path 20 has a first fluid path inlet 22 in the first water chamber 6. The first fluid path 20 has a first fluid path outlet 23 in the second water chamber 7.

The first fluid path outlet 23 is disposed above the first fluid path inlet 22 when the steaming body 2 is in its normal operating position. That is, the perpendicular distance between the plane of the ironing surface 12 and the first fluid path outlet 23 is greater than the perpendicular distance between the plane of the ironing surface 12 and the first fluid path inlet 22.

The first fluid path 20 is bent. That is, the first fluid path 20 defines a non-linear passageway. The first fluid path 20 has a first part 20*a* and a second part 20*b*. The first part 20*a* extends between the first and second water chambers 6, 7. The second part 20*b* extends from one end of the first part 20*a*. The second part 20*b* extends at an angle to the first part 20*a*. In the present embodiment, the second part 20*b* extends perpendicular to the first part 20*a*. The first fluid path 20 may define a curved or angled fluid path. The second part 20*b* of the first fluid path 20 extends in the first water chamber 6. A tubular passageway is defined along the first and second parts 20*a*, 20*b*. The second part 20*b* extends downwardly. That is, the second part 20*b* extends towards the plane of the ironing surface 12 from the first part 20*a*.

The flow rate of water through the first fluid path 20 is restricted. That is the first fluid path 20 is configured to allow the flow of water from the first fluid chamber 6 to the second fluid chamber 7 at a controlled rate.

The second water chamber 7 has an air vent 25 communicating the second water chamber 7 with atmospheric air. The air vent 25 allows the flow of air out of the second water chamber 7 when water flows into the second water chamber 7 through the first fluid path 20. The air vent 25 also allows the flow of air into the second water chamber 7 when water flows from the second water chamber 7 to the second fluid path 26. The air vent 25 extends from an upper end of the second water chamber 7. The air vent 25 extends from the second water chamber 7 towards the front end 13 of the steaming body 2. This restricts water in the second water chamber 7 from flowing along the air vent 25 out of the steaming body 2 when the steaming body 2 is tilted.

The upper end of the second water chamber 7 is above the upper end of the first water chamber 6 when the steaming body is orientated in the normal operating position. This provides a greater head of water in the second water chamber 7. In the present embodiment, the upper end of the second water chamber 7 is spaced from the first fluid path outlet 23.

A second fluid path 26 extends from the second water chamber 7. The second fluid path 26 communicates the second water chamber 7 with the steam generator 8. The second fluid path 26 comprises a second fluid path inlet 27 and a second fluid path outlet 28. The second fluid path inlet 27 communicates with the lower end of the second water chamber 7. The second fluid path outlet 28 communicates with the steam generator 8. The steam generator 8 has a water feed unit 29. The water feed unit 29 has a flow restrictor 30 configured to control the flow rate of water into the steam chamber 10. The flow restrictor 30 is adjustable to adjust the rate of flow of water from the second water chamber 7 to the steam chamber 10. The flow restrictor is adjusted by means of a flow shaft 32. The rate of steam generated by the steam generator 8 is dependent on the rate of water flow into the steam chamber 10. Therefore, the steam rate is adjustable. The flow shaft 32 is adjustable by a user controllable input knob 33.

The second fluid path outlet 28 is spaced from the second fluid path inlet 27. The second fluid path outlet 28 is disposed towards the front end 13 of the steaming body 2. The second fluid path outlet 28 is configured to be disposed above the upper end of the second water chamber 7 when the steaming body 2 is into a rest position. The rest position of the steaming body 2 is when the steaming body 2 is tilted into an inclined orientation relative to the normal operating position of the steaming body 2 with the front end 13 of the steaming body 2 tilted upwards. This prevents the flow of water along the second fluid path 26 into the steam chamber 10 when the steaming body 2 is tilted into its rest position.

The steaming body 2 has a handle 34 to aid grasping and manoeuvring of the steaming body 2. The steaming body 2 is locatable on the stand 3. The steaming body 2 is configured to be removably supported on the stand 3. The steaming body has electrical contacts on the housing which are configured to communicate with corresponding electrical contacts on the stand 3 when the steaming body 2 is on the stand 3.

The stand 3 has a support arrangement 35 for receiving and supporting the steaming body 2. The support arrangement 35 has a heel receiving surface 36 for receiving the heel 17 of the steaming body 2. The heel receiving surface 36 is defined by a recess. The stand 3 also has a sole plate receiving surface 37 for receiving the sole plate 5 of the steaming body 2. When the steaming body 2 is placed on the stand 3, the heel 17 of the steaming body 2 is placed in the recess defining the heel receiving surface 36, and the sole plate 5 is rested against the sole plate receiving surface 37.

The stand 3 supports the steaming body 2 in the rest position. That is, when the steaming body 2 is received by the stand 3, the steaming body is disposed in a tilted orientation in which the steaming body is inclined by an angle with respect to the steaming body's normal operating position. In the rest position the front end 13 points upwardly. That is, the front end 13 of the steaming body 2 is above the heel 17 of the steaming body 2.

In the present arrangement, the rest position of the steaming body 2 is when the steaming body is orientated at an angle of 30 degrees from the normal operating position of the steaming body 2 with the front end 13 of the steaming body 2 pointing upwardly. However, it will be understood that the rest position of the steaming body 2 may vary. In particular, the rest position of the steaming body 2 may be configured so that the steaming body 2 is orientated at another angle from the normal operating position of the steaming body 2.

In the normal operating position of the steaming body 2, the steaming body 2 is orientated so that the ironing surface 12 is in a horizontal orientation. When the steaming body 2 is on the stand 3 in its rest position the ironing surface 12 extends at an angle of 30 degrees to the horizontal. The stand 3 has a base 38. The base 38 defines the contact points against which the stand 3 rests on a horizontal surface. The base 38 may be formed by feet spaced from each other. The base 38 defines a base plane, and so when the steaming body 2 is on the stand 3 in its rest position the ironing surface 12 extends at an angle of 30 degrees to the base plane. It will be understood that the angle may vary.

The stand 3 has a power supply 39. The power supply 39 supplies energy to the steaming body 2 when the steaming body 2 is received on the stand 3. The power supply 39 provides electrical energy to the steaming body 2 to operate the heater 9 and so heat the sole plate 5. Therefore, the sole plate 5 is heated when the steaming body 2 is supported on the stand 3. When the steaming body 2 is removed from the stand 3 the power supply 39 is disconnected from the steaming body 2.

The power supply 39 is connected to the steaming body 2 by electrical contacts on the steaming body 2 and stand 3 which align with each other and locate against each other when the steaming body is in its rest position on the stand. The electrical contacts provide an electrical connection between the power supply 39 and the heater 9.

Figure 2:
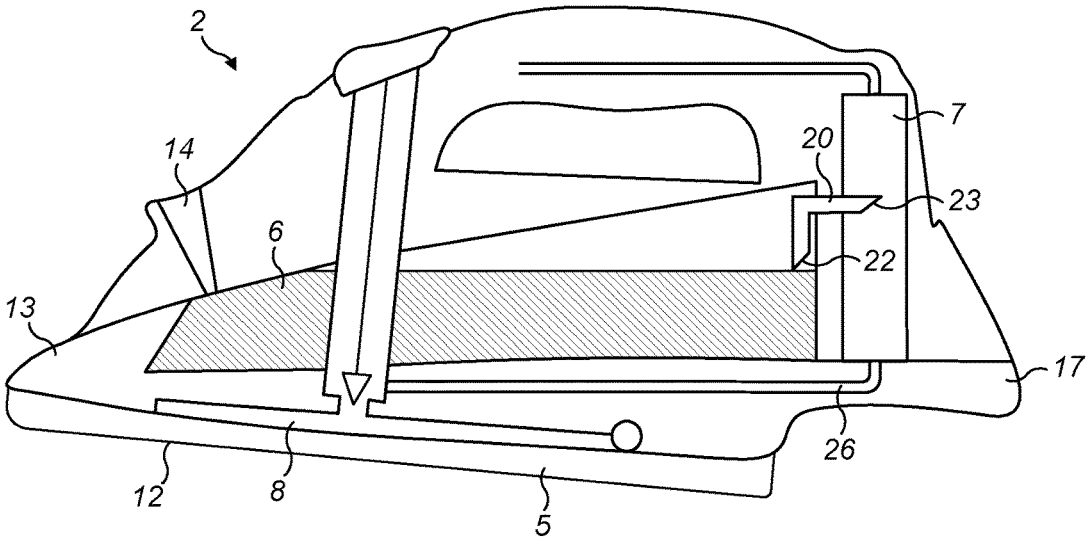
FIG. 2 shows a cross-sectional side view of the steaming body of the cordless steam iron shown in FIG. 1 orientated in a normal operating position and with water being received in the steaming body prior to being moved into a rest position.

Referring to FIG. 2, the steaming body 2 of the cordless steam iron 1, acting as a garment steaming device, is shown in its normal operating position. That is, the steaming body 2 is disposed with the ironing surface 12 of the sole plate 5 extending along a horizontal plane. The steaming body 2 is removed from the stand 3. In this position the power supply 39 is disconnected from the heater 9.

To fill the steaming body 2 with water, a user pours water into the first water chamber 6 by the filling port 14. Water flows along the filling port 14 into the first water chamber 6. However, the first fluid path 20 is at the upper end of the first water chamber 6, that is the maximum perpendicular distance from the plane of the ironing surface 12, and so water is restricted from flowing into the second water chamber 7. Therefore, a user is able to fill the first water chamber 6 to its maximum capacity without water flowing into the second water chamber 7.

Figure 3:
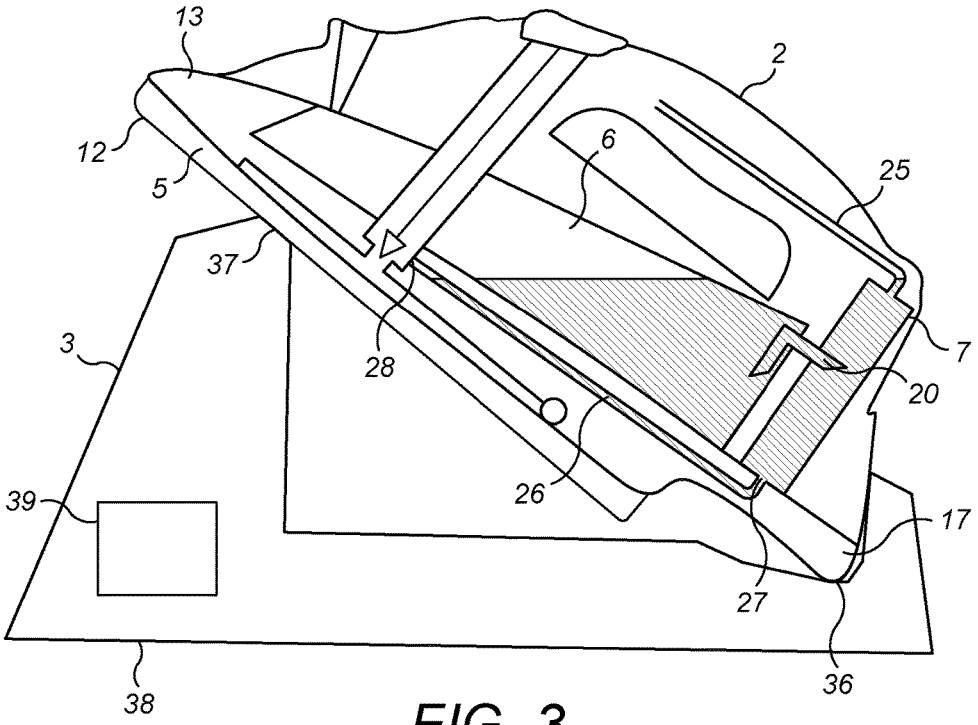
FIG. 3 shows another cross-sectional side view of the cordless steam iron with a steaming body received on a stand with the steaming body in its rest position so that water is received in the first water chamber and a second water chamber.
Figure 4:
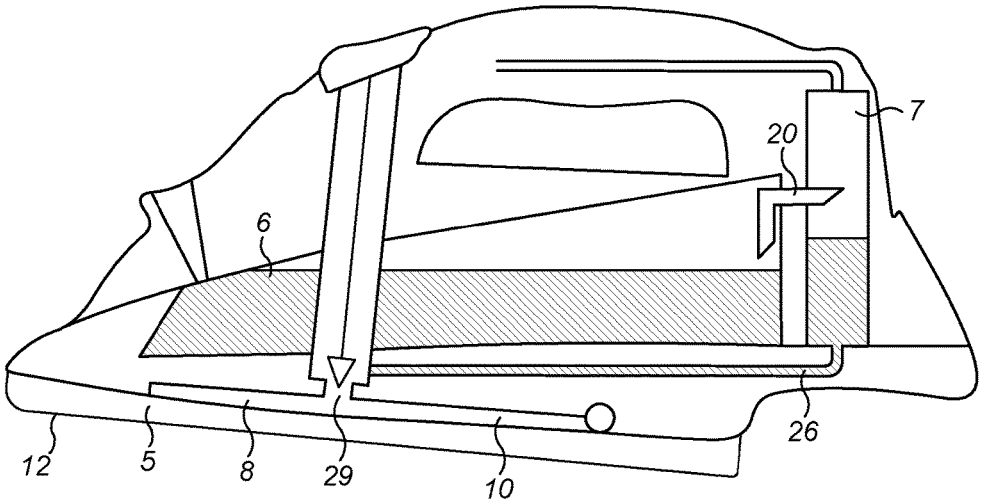
FIG. 4 shows another cross-sectional side view of the steaming body of the cordless steam iron shown in FIG. 1 orientated in the normal operating position and with water being received in the steaming body after being orientated in its rest position.

Referring to FIGS. 1 and 3, the stand 3 is placed on a horizontal surface. That is, the base 38 of the stand 3 locates against the surface. The stand 3 is connected to a mains power supply. The steaming body 2 is placed on the stand 3. That is, the steaming body 2 is tilted from its normal operating position into its rest position and supported on the stand 3 in its rest position. In the rest position, the steaming body 2 is orientated at an angle of 30 degrees to the normal operating position, with the front end 13 tilted upwardly, and the heel 17 positioned lowermost.

When the steaming body 2 is disposed on the stand 3 in its rest position, the power supply 39 in the stand is connected to the steaming body 2. A controller then supplies energy from the power supply 39 to the heater 9. The heater 9 heats the sole plate 5. As the steaming body 2 is moved from its normal operating position into its rest position, the first water chamber 6 and second water chamber 7 are rotated relative to each other. The heel 17 of the steaming body 2 is rotated below the front end 13 of the steaming body 2. Therefore, the rear end of the first water chamber 6 is disposed below the front end. The first fluid path inlet 22 to the first fluid path 20 moves below the water level of the water received in the first water chamber 6 as shown in FIG. 3. Therefore, water flows along the first fluid path 20. When the steaming body 2 is in the rest position, water flows by the force of gravity from the first water chamber 6 to the second water chamber 7. The first fluid path outlet 23 is below the water level of water received in the first water chamber 6.

The flow rate of water along the first fluid path 20 is controlled. The flow rate along the first fluid path 20 is limited by the diameter of the first fluid path 20, although it will be understood that the flow rate may be limited by another restriction. The first fluid path 20 is configured to limit the water flow rate along the first fluid path 20 as a function of the rate of energy provided to heat the sole plate 5 at a predetermined rate. The rate at which the second fluid chamber 7 is filled with water is controlled so that the energy provided to the steam generator 8 at any stage is sufficient to evaporate the volume of water in the second fluid chamber 7 and use it to press a fabric without water leaking out from the steaming body 2. This ensures that the volume of water available to the steam generator 8 does not exceed the stored energy capacity of the steam generator 8 that is available to evaporate the water at any given stage. Therefore, sufficient heat energy is available to evaporate the total volume of water in the second water chamber 7 and so ironing can be performed without water leakage, irrespective of the quantity of energy supplied to, and therefore charging time of, the steaming body 2.

In the present embodiment, the flow rate of water between the first and second water chambers 6, 7 is 1 g/s. This corresponds to a heater having a power rating of 2400 W. However, it will be understood that alternative corresponding flow rates and charge rates may be used. For example, when the flow rate of water between the first and second water chambers 6, 7 is 0.5 g/s, a heater having a power rating of 1200 W may be used.

The heat capacity of the sole plate 5 defines the stored energy capacity of the steaming body 2. It will be understood that in an alternative arrangement an additional component may contribute to the stored energy capacity of the steaming body 2. For example, the steam generator 8 may be separate to the sole plate and have an alternative heated body. Alternatively, or in combination with, the steaming body 2 may have a small battery which retains electrical energy to continue to operate the heater when the steaming body 2 is disconnected from the power supply.

The steaming body 2 has a maximum stored energy capacity. This is the total energy capacity that the steaming body 2 is able to retain to provide heat to the steam generator 8. The stored energy capacity of the steaming body 2 is used to convert water fed to the steam generator 8 into steam. The stored energy capacity of the steaming body 2 is used to convert water flowing from the second water chamber 7. In the present embodiment, the maximum stored energy capacity of the steaming body 2 is the maximum heat capacity of the sole plate 5, which is heated by the heater 9.

The second water chamber 7 is configured to hold a maximum volume of water. The maximum volume of water that the second water chamber 7 is able to hold is a function of the maximum energy capacity of the steaming body 2. That is the maximum volume of the second water chamber 7 correlates to the volume of water that the heat retained by the sole plate 5 is able to convert into steam before the temperature of the sole plate 5 drops below a minimum temperature at which it is able to evaporate water. Therefore, the second water chamber 7 is configured to empty before the temperature of the sole plate 5 drops below the threshold value. In the present embodiment, the maximum volume of water is between 10 g and 20 g, although it will be appreciated that the volume is not limited thereto. This correlates to a maximum stored energy capacity of 25 KJ to 50 KJ.

It will be understood that the steaming body 2 may be filled with water once the steaming body 2 has been placed on the stand 3. Therefore, the power supply 39 will provide the heater with energy prior to water beginning to fill the second water chamber 7. However, it will be understood that the sole plate 5 cannot exceed its maximum heat capacity and so the sole plate 5 will be at its maximum heat capacity upon the second water chamber 7 reaching its maximum volume.

A section of the housing is transparent or translucent in the region of the second water chamber 7. Therefore, it is possible to determine the volume of water present in the second water chamber 7. The housing has a window to view the volume of water in the second water chamber 7. The window extends the height of the second water chamber 7 to enable a user to view when the second water chamber 7 is full or empty. The window extends between the lower end of the second water chamber 7 and the upper end of the second water chamber 7. The water level in the second water chamber 7 allows a user to determine the operating state of the steaming body 2. For example, when the cordless steam iron is operated, and the steaming body 2 is placed on the stand, it is possible to determine when the steaming body 2 is charged to its maximum stored energy capacity based on the water level in the second water chamber 7 reaching its maximum extent. That is, the steaming body 2 is at its maximum stored energy capacity when the second water chamber 7 is full of water, because the filling rate of the second water chamber 7 is a function of the energy charging rate of the sole plate 5. Similarly, it is possible to determine when the steaming body 2 is in a state in which it needs to be returned to the stand to be recharged because the heat capacity is too low to evaporate water based on the water level in the second water chamber 7 reaching its minimum extent. That is, the steaming body 2 is at a minimum stored energy capacity when the second water chamber 7 is empty of water, because the energy usage rate or discharge rate of the steaming body 2 is a function of the flow rate of water to the steam generator 8.

The stored heat capacity of the steaming body 2 correlating to the flow rate of water to the steam generator 8 enables a user to be able to observe when it is necessary to recharge the steaming body 2. Therefore, the second water chamber 7 is able to act as an indicator to the user. This minimises the cost of manufacture as it is not necessary to provide a separate audio or visual indicator to the user. Although a window is used in the present embodiment, it will be understood that alternative configurations may be used. For example, a float indicator may indicate the water level in the second water chamber 7.

When the steaming body 2 is received in its rest position, the second fluid path outlet 28 is disposed above the upper water level in the second water chamber 7, as shown in FIG. 3. Therefore, water is prevented from flowing out of the second fluid path 26 into the steam generator 8 when the steaming body 2 is in its rest position. This means that the steam generator 8 is restricted from producing steam when the steaming body 2 is in its rest position.

When the second water chamber 7 is filled to capacity with water, a user is able to determine that the steam generator 8 is fully charged. That is, in the present embodiment the sole plate 5 is at its maximum heat capacity. The steaming body 2 is then removed from the stand 3. Therefore, the heater 9 is disconnected from the power supply 39 and the supply of power to the steaming body 2 stops. The user then orientates the steaming body 2 into its normal operating position.

When the steaming body 2 is orientated into its normal operating position, the first and second water chambers 6, 7 are rotated relative to each other. The first fluid path outlet 23 is orientated above the water level in the first water chamber 6, and so water is no longer urged to flow along the first fluid path 20 from the first water chamber 6 into the second water chamber 7. The second fluid path outlet 28 is disposed below the water level in the second water chamber 7. Therefore, the hydraulic head of the water urges the water to flow from the second water chamber 7, through the second fluid path 26 and out of the second fluid path outlet 28.

In the normal operating position, water is urged to flow from the second water chamber 7 to the steam generator 8. The water flows through the flow restrictor 30 into the steam chamber 10. The steam restrictor 30 is adjustable to adjust the rate of flow of water from the second water chamber 7 to the steam chamber 10. The rate of steam generated by the steam generator 8 is dependent on the rate of water flow into the steam chamber 10.

Water received in the steam chamber 10 is evaporated to create steam. Water in the steam chamber 10 is heated by the heat energy of the sole plate 5. As steam is generated, the pressure in the steam chamber 10 increases and steam is forced to flow through the steam apertures in the sole plate 5. Therefore, steam flows from the steam chamber 10 to emerge from the ironing surface 12.

The user holds the steaming body 2 by its handle 34 and locates the ironing surface 12 against a fabric on an ironing board. The steam emitted from the ironing surface 12 is therefore directed against the fabric to press the fabric. The steaming body 2, and therefore the ironing surface 12, may be moved across the fabric to act on different sections of the fabric.

As the water received by the steam generator 8 is evaporated by the heat energy the sole plate 5 begins to cool. Heat also transfers from the ironing surface 12 to the fabric. The heat transferring from the ironing surface 12 to the fabric helps to prevent condensation forming on the fabric. The water usage of the steam generator 8 corresponds to the rate of decrease in temperature of the sole plate 5. That is, the rate of water usage from the second water chamber 7 is a function of the rate of energy usage of the sole plate 5.

If during use of the iron, the user tilts the steaming body 2 into the rest position on the stand 3, the second fluid path outlet 28 moves above the water level in the second water chamber 7. Therefore, water is prevented from flowing to the steam generator 8 and steam generation is restricted. This means that water usage is minimised, together with energy usage as the rate of cooling of the sole plate is reduced when the steam generator 8 is not evaporating water. When the user moves the steaming body 2 back into its normal operating position, steam generation automatically restarts as the second fluid path outlet 28 moves below the water level in the second water chamber 7 and water flows to the steam generator 8. Therefore, it is not necessary for a user to manually actuate steam generation.

As a user moves the steaming body 2 along the fabric, water in the first water chamber 6 and second water chamber 7 moves in the chambers and may form waves or splashes. However, the first fluid path outlet 23 is offset from the first fluid path inlet 22 when the steaming body 2 is in its normal operating position. The first fluid path outlet 23 is disposed higher than the first fluid path inlet 22. Therefore, an indirect path is formed between the first and second water chambers 6, 7 and makes it difficult for water to accidently pass along the first fluid path 20. Furthermore, the first fluid path outlet 23 is disposed above the maximum water level in the first water chamber 6. This means that the volume of water that is available to the steam generator 8 is restricted to the specific volume of water in the second water chamber 7 when the steaming body 2 is in its normal operating position.

When a user detects that the water level in the second water chamber 7 is at a minimum level, it is apparent that the steaming body 2 needs to be replaced on the stand 3 to be recharged.

As the rate at which the second water chamber 7 is filled is a function of the rate of heating of the sole plate 5, it will be understood that the steaming body 2 may be removed from the stand 3 prior to the sole plate reaching its maximum heat capacity without excess water being received in the second water chamber 7.

The steam rate generated by the steam generator 8 may be adjusted by adjusting the flow restrictor 30 of the water feed unit 29. This varies the flow of water to the steam generator 8. However, it will be understood that by varying the quantity of water fed to the steam generator 8 the rate at which the sole plate 5 cools down will vary accordingly, and so the temperature of the sole plate 5 will not drop below the minimum threshold temperature prior to the water in the second water chamber 7 being exhausted.

The second fluid path inlet 27 to the second fluid path 26 is disposed at the lower end of the second water chamber 7 and so all the water received in the second water chamber 7 is able to flow into the second fluid path 26 when the steaming body 2 is in its normal operating position. Furthermore, the second fluid path outlet 28 is below the second fluid path inlet 27 when the steaming body 2 is in its normal operating position, and so all the water in the second water chamber 7 is able to flow to the steam generator 8.

When the second water chamber 7 is filled with water and the steaming body 2 is rotated into the normal operating position, the water level in the second water chamber 7 is above the first fluid path 20 and the water level in the first water chamber 6. The first fluid path 20 has a one-way valve. The one-way valve acts to prevent the flow of water from the second water chamber 7 to the first water chamber 6. However, it will be understood that the one-way valve may be omitted. Alternatively, the upper end of the second water chamber 7 does not extend above the first fluid path 20.

Figure 5:
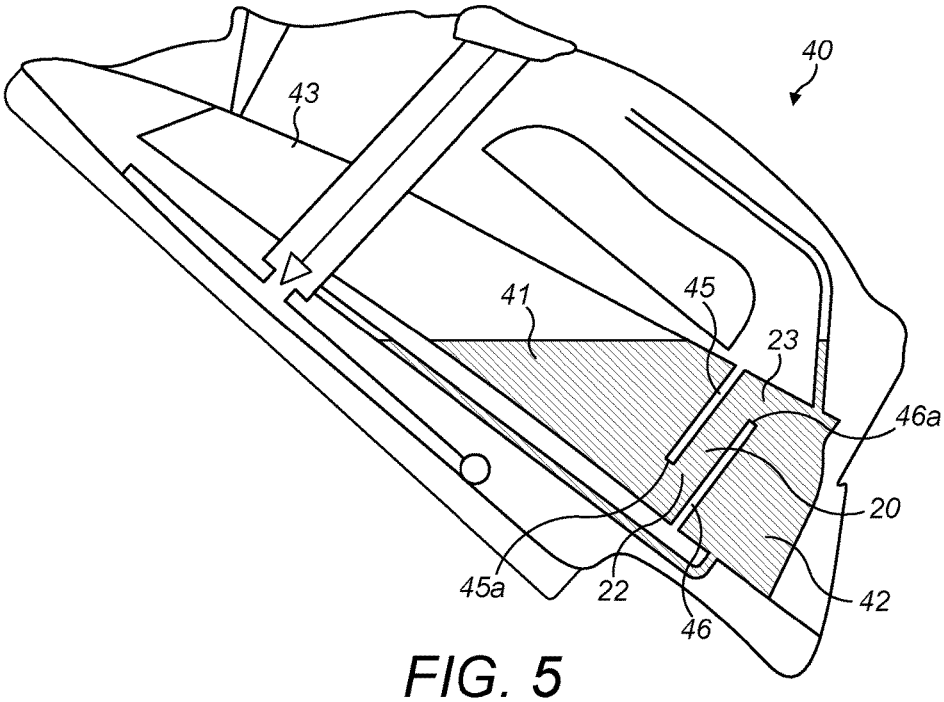
FIG. 5 shows a cross-sectional side view of another embodiment of a cordless steam iron with a steaming body in its rest position and with water received in the steaming body.
Figure 6:
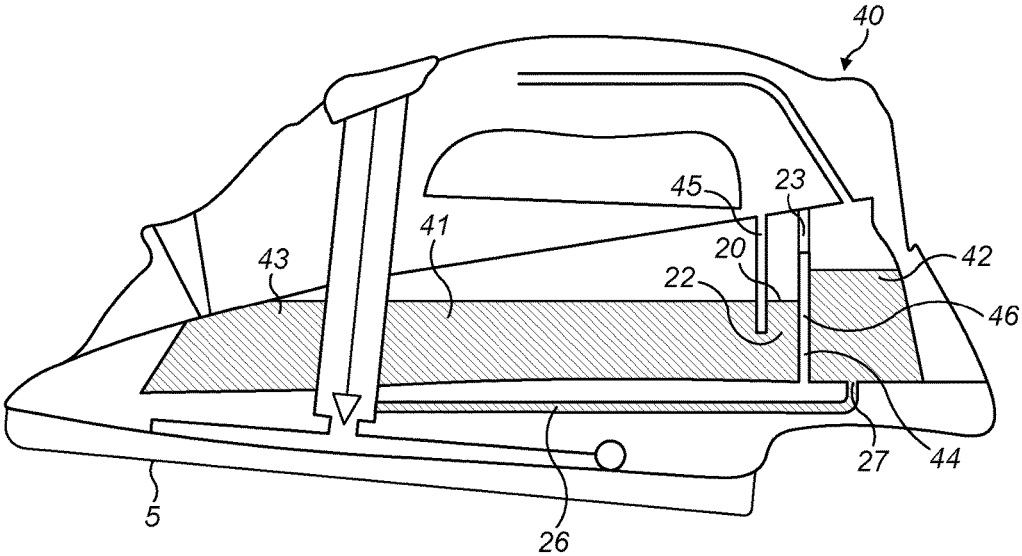
FIG. 6 shows a cross-sectional side view of the steaming body of the cordless steam iron shown in FIG. 5 orientated in a normal operating position and with water received in the steaming body after being orientated in its rest position.
Figure 7:
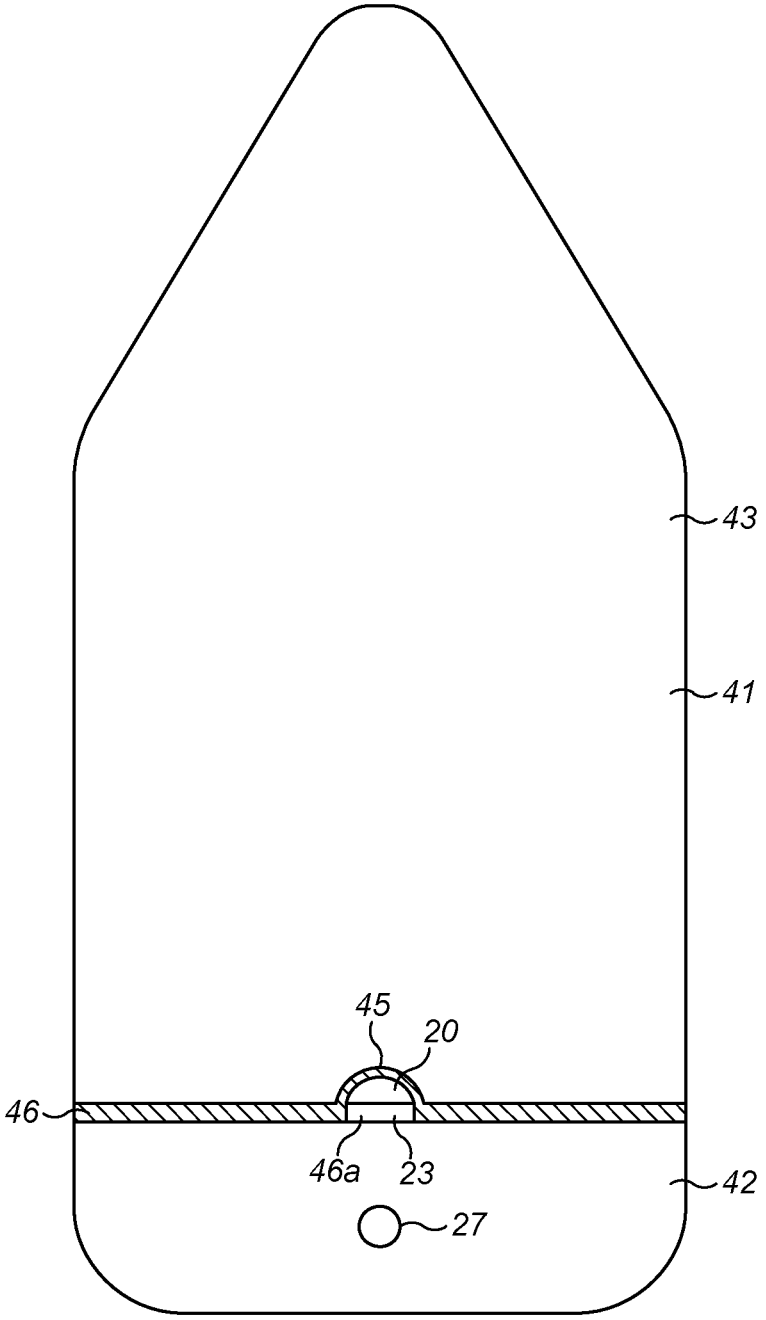
FIG. 7 shows a cross-sectional top view of a water tank of the steaming body of the cordless steam iron shown in FIG. 5.

Referring now to FIGS. 5 to 7, an alternative arrangement of the steaming body 40 is shown. The steaming body 40 shown in FIGS. 5 and 6 has generally the same arrangement and features as the steaming body shown in FIGS. 1 to 4 and so a detailed description will be omitted herein. Furthermore, the stand described above and shown in FIG. 1 may be used together with the steaming body described below.

In the embodiment shown in FIGS. 5 to 7, a first water chamber 41 and a second water chamber 42 are defined in a main water tank 43 acting as a water reservoir. The water tank 43 defines a single sealed space for receiving water. However, the water tank 43 has a divider 44 extending therein. The divider 44 comprises a first wall 45 and a second wall 46. The first and second walls 45, 46 extend from an inner surface of the water tank 43. The first wall 45 distends from an upper end of the water tank 43. The second wall 46 distends from a lower end of the water tank 43. The first fluid path 20 is defined between the first and second walls 45, 46. The first wall 45 extends from the second wall 46. That is, side ends of the first wall 45 are integrally formed with the second wall 46. A bottom end 45*a* of the first wall 45 defines the first fluid path inlet 22. That is, the bottom end 45*a* or a section of the bottom end 45*a* of the first wall 45 is spaced from the lower end of the water tank 43 to define the first fluid path inlet 22. A top end 46*a* of the second wall 46 defines the first fluid path outlet 23. That is, the top end 46*a* or a section of the top end 46*a* of the second wall 45 is spaced from the upper end of the water tank 43 to define the first fluid path outlet 23. The first wall 45 is arcuate, however it will be understood that other arrangements are possible.

In an alternative arrangement, the first fluid path inlet and/or first fluid path outlet may each be formed by one or more apertures. In one arrangement, the first and second walls may extend parallel to each other in the water tank. An aperture may be formed at the bottom end of the first wall to define the first fluid path inlet. Another aperture may be formed at the top end of the second wall to define the first fluid path outlet.

As the first fluid path inlet 22 is formed at or towards the lower end of the first wall 45 and the first fluid path outlet 23 is formed at or towards the upper end of the second wall 46, the first fluid path inlet 22 and first fluid path outlet 23 are offset from each other. When the steaming body 40 is in its normal operating position, as shown in FIG. 6, water is restricted from flowing along the first fluid path 20 to the second water chamber 42.

When the steaming body 40 is orientated into its rest position, water is able to flow along the first fluid path 20 from the first water chamber 41 to the second water chamber 42. The flow rate through the first fluid path 20 is determined by the area of the first fluid path 20. Alternatively, the flow rate through the first fluid path 20 is determined by the area of the first fluid path inlet 22 or first fluid path outlet 23.

Although in the present embodiment the divider 44 comprises first and second walls 45, 46, it will be understood that in an alternative embodiment the first wall 45 distending from the upper end of the water tank 43 is omitted. An advantage of the first wall 45 is that it restricts the accidental flow of water into the second water chamber 42 when the steaming body 40 is moved in its normal operating position.

Although one arrangement for supporting the steaming body 2, 40 in its rest position is described in the above described embodiments, it will be understood that alternative support arrangements are envisaged.

Although in the above described embodiments the steaming device is a cordless steam iron, it will be understood that the invention is not limited thereto and that the features described above may be or form part of another garment steaming device. For example, the garment steaming device may be a cordless garment steamer. Alternatively, the steaming device may be an alternative steaming device which is not arranged to steam garments. For example, the steaming device may be a handheld steamer device configured to treat hard surfaces such as table tops or floors, or configured to treat soft surfaces such as textile coverings of furniture or mattresses.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A steaming device operable in a cordless mode comprising:

a steaming body having a first water chamber having a principal dimension in a horizontal direction between a front face and a rear face of the first water chamber when the steaming body is oriented in an operational position, a second water chamber having a principal dimension in a vertical direction when the steaming body is oriented in the operational position, the second water chamber being separated from the first water chamber via a vertical wall at the rear face of the first water chamber that extends along the principal dimension of the second water chamber, a steam generator, a first fluid path between the first water chamber and the second water chamber, the first fluid path including a tubular fluid passage extending through the vertical wall proximate an upper end of the rear face of the first water chamber and having an inlet and an outlet, wherein (i) the fluid passage inlet is disposed at a first end of the tubular fluid passage extending in a downward direction along the vertical wall, and (ii) the fluid passage outlet is disposed horizontally at a second end of the tubular fluid passage in the second water chamber above a maximum water level in the first water chamber, when the steaming body is oriented in the operational position, and a second fluid path between the second water chamber and the steam generator, wherein the first fluid path prevents water flow from the first water chamber to the second water chamber when the steaming body is orientated in the operational position and allows water flow from the first water chamber to the second water chamber when the steaming body is orientated in a non-operational position in which the steaming body is inclined at an angle to the operational position.

2. The steaming device according to claim 1, wherein the second fluid path prevents water flow to the steam generator when the steaming body is orientated in the non-operational position.

3. The steaming device according to claim 2, wherein the second fluid path has a second fluid path outlet to the steam generator which is disposed above a maximum water level in the second water chamber when the steaming body is orientated in the non-operational position.

4. The steaming device according to claim 1, wherein the second fluid path allows water flow to the steam generator when the steaming body is orientated in the operational position.

5. The steaming device according to claim 1, further comprising a power supply, wherein the flow rate of water through the first fluid path is a function of the rate of energy transfer from the power supply to the steam generator so that the stored energy capacity of the steam generator is sufficient to evaporate the volume of water in the second water chamber.

6. The steaming device according to claim 1, wherein the second water chamber is configured to hold a maximum volume of water, the volume of water being a function of the maximum stored energy capacity of the steam generator which is capable of evaporating the volume of water.

7. The steaming device according to claim 1, wherein the first fluid path defines a non-linear path between the first fluid path inlet and the first fluid path outlet.

8. The steaming device according to claim 1, further comprising a water reservoir, the first water chamber and second water chamber being defined in the water reservoir by a divider with the first fluid path outlet at an upper end of the divider.

9. A steaming device operable in a cordless mode comprising:

a steaming body having a first water chamber, a second water chamber, a steam generator, a first fluid path between the first water chamber and the second water chamber, a second fluid path between the second water chamber and the steam generator, and a water reservoir, wherein the first fluid path prevents water flow from the first water chamber to the second water chamber when the steaming body is orientated in an operational position and allows water flow from the first water chamber to the second water chamber when the steaming body is orientated in a non-operational position in which the steaming body is inclined at an angle to the operational position, wherein the first fluid path has a first fluid path outlet to the second water chamber which is above a maximum water level in the first water chamber when the steaming body is orientated in the operational position, the first water chamber and second water chamber being defined in the water reservoir by a divider with the first fluid path outlet at an upper end of the divider, and wherein the divider comprises a first wall and a second wall, the first fluid path being defined between the first wall and the second wall.

10. The steaming device according to claim 9, wherein the first fluid path inlet is formed at a lower end of the first wall, and the first fluid path outlet is formed at an upper end of the second wall.

11. The steaming device according to claim 1, further comprising a stand configured to removably support the steaming body in a non-operational position in which the steaming body is inclined at an angle to the operational position.

12. The steaming device according to claim 11, wherein the stand is configured to provide a supply of energy to the steaming body when the steaming body is received on the stand.

13. The steaming device according to claim 1, wherein the steaming body is inclined at an angle of at least 30 degrees to an operational position when the steaming body is orientated in the non-operational position.

14. The steaming device according to claim 1, wherein the steaming device operable in a cordless mode is a cordless steam iron or a cordless garment steamer for steaming garments.

15. The steaming device according to claim 9, wherein the second fluid path prevents water flow to the steam generator when the steaming body is orientated in the non-operational position.

16. The steaming device according to claim 9, wherein the second fluid path has a second fluid path outlet to the steam generator which is disposed above a maximum water level in the second water chamber when the steaming body is orientated in the non-operational position, and wherein the second fluid path allows water flow to the steam generator when the steaming body is orientated in the operational position.

17. The steaming device according to claim 9, further comprising a power supply, wherein the second water chamber is configured to hold a maximum volume of water, wherein a flow rate of water through the first fluid path is a function of the rate of energy transfer from the power supply to the steam generator so that a stored energy capacity of the steam generator is sufficient to evaporate the maximum volume of water in the second water chamber.

18. The steaming device according to claim 9, further comprising a stand configured to removably support the steaming body in a non-operational position in which the steaming body is inclined at an angle to the operational position.

19. The steaming device according to claim 18, wherein the stand is configured to provide a supply of energy to the steaming body when the steaming body is received on the stand.

20. The steaming device according to claim 9, wherein the steaming body is inclined at an angle of at least 30 degrees to an operational position when the steaming body is orientated in the non-operational position.

* * * * *